US010401131B1

(12) United States Patent
Remaklus et al.

(10) Patent No.: US 10,401,131 B1
(45) Date of Patent: Sep. 3, 2019

(54) TARGET SYSTEMS AND METHODS FOR PROJECTILES

(71) Applicant: LOCKED IN SPORTS LLC, Ferndale, WA (US)

(72) Inventors: Justin Scott Remaklus, Ferndale, WA (US); Aaron John Dickson, Lynden, WA (US); Lucas Grant Berendsen, Bellingham, WA (US); Jacob Cooper Locker, Ferndale, WA (US)

(73) Assignee: LOCKED IN SPORTS LLC, Bellingham, WA (US)

( * ) Notice: Subject to any disclaimer, the term of this patent is extended or adjusted under 35 U.S.C. 154(b) by 0 days.

(21) Appl. No.: 16/121,406

(22) Filed: Sep. 4, 2018

Related U.S. Application Data

(60) Provisional application No. 62/596,143, filed on Dec. 8, 2017, provisional application No. 62/553,211, filed on Sep. 1, 2017, provisional application No. 62/553,131, filed on Sep. 1, 2017.

(51) Int. Cl.
*F41J 1/10* (2006.01)
*F41J 3/00* (2006.01)

(52) U.S. Cl.
CPC .. *F41J 3/00* (2013.01); *F41J 1/10* (2013.01)

(58) Field of Classification Search
CPC .. F41J 1/00; F41J 1/10; F41J 7/00; F41J 7/04
USPC ..... 273/390–392, 403–408
See application file for complete search history.

(56) References Cited

U.S. PATENT DOCUMENTS 1,783,303 A * 12/1930 Oberndorfer ..... F41J 3/0071 273/335
3,080,166 A * 3/1963 Clark ..... F41J 1/10 248/201
3,392,980 A 7/1968 Ortega
3,540,729 A * 11/1970 Rahberger ..... F41J 1/10 248/156
4,029,318 A * 6/1977 Boss ..... F41J 1/10 108/118
4,040,624 A 8/1977 Lee
4,395,040 A 7/1983 White
5,022,649 A 6/1991 Traub et al.
5,088,672 A 2/1992 Neuendorf et al.
(Continued)

FOREIGN PATENT DOCUMENTS

WO 2018140511 A1 8/2018

OTHER PUBLICATIONS

USPTO, "Non-Final Office Action, U.S. Appl. No. 15/620,575," dated Dec. 21, 2018, 18 pages.
(Continued)

*Primary Examiner* — Mark S Graham
(74) *Attorney, Agent, or Firm* — Michael R. Schacht; Schacht Law Office, Inc.

(57) ABSTRACT

A target system for projectiles comprises a support system, a primary target, and a secondary target. The support system defines a support portion. The primary target comprises a target portion defining a front side and a rear side, a hanging portion, and a clip arranged on a rear side of the target portion. The clip is adapted to engage the secondary target to secure a secondary target relative to the primary target. The hanging portion is adapted to engage the support portion of the support system to support the primary target at a desired location.

16 Claims, 11 Drawing Sheets

(56) References Cited

U.S. PATENT DOCUMENTS

| | | | | |
|---|---|---|---|---|
| 5,240,258 | A | 8/1993 | Bateman | |
| 5,277,432 | A | 1/1994 | Bateman | |
| 5,279,496 | A | 1/1994 | Schroeder | |
| 5,342,062 | A | 8/1994 | Lance | |
| 5,346,226 | A | 9/1994 | Block | |
| 5,570,880 | A | 11/1996 | Nordgran | |
| 5,632,491 | A * | 5/1997 | Hamas | F41J 1/10 24/501 |
| 5,678,824 | A * | 10/1997 | Fortier | F41J 1/10 273/400 |
| 5,816,955 | A | 10/1998 | Nordgran et al. | |
| 5,893,807 | A | 4/1999 | Aikens | |
| 6,056,654 | A | 5/2000 | Schroeder | |
| 6,808,177 | B2 | 10/2004 | Dehart | |
| 7,331,882 | B1 | 2/2008 | White | |
| 7,614,626 | B1 * | 11/2009 | Aanerud | F41J 9/02 273/366 |
| 7,845,646 | B1 | 12/2010 | Weber | |
| 8,172,231 | B2 | 5/2012 | Massier | |
| 8,403,329 | B2 | 3/2013 | Krickovic | |
| 8,534,672 | B2 | 9/2013 | Brune | |
| 8,684,361 | B2 * | 4/2014 | Henson | F41J 1/01 273/389 |
| 8,708,294 | B2 | 4/2014 | Lam et al. | |
| 8,724,037 | B1 | 5/2014 | Massey | |
| 8,807,570 | B1 * | 8/2014 | Zalar | F41J 7/04 273/390 |
| 9,303,959 | B2 | 4/2016 | Doria | |
| 9,545,552 | B1 | 1/2017 | Buchweitz | |
| 2002/0105477 | A1 | 8/2002 | Bragg et al. | |
| 2006/0261226 | A1 | 11/2006 | Petrick et al. | |
| 2007/0013138 | A1 * | 1/2007 | Hinnant | F41J 1/01 273/407 |
| 2007/0234616 | A1 | 10/2007 | Betham et al. | |
| 2008/0023915 | A1 | 1/2008 | Morrow et al. | |
| 2008/0185786 | A1 * | 8/2008 | Loveland | F41J 7/04 273/391 |
| 2008/0272548 | A1 * | 11/2008 | Hensley | F41J 1/10 273/406 |
| 2009/0163305 | A1 | 6/2009 | Connerley et al. | |
| 2011/0024985 | A1 * | 2/2011 | Potterfield | F41J 1/01 273/348 |
| 2013/0241152 | A1 * | 9/2013 | Fodera | F41J 1/10 273/407 |
| 2014/0284879 | A1 * | 9/2014 | Hendrix | F41J 1/10 273/407 |
| 2015/0260486 | A1 * | 9/2015 | Trimbath | F41J 7/04 273/407 |
| 2015/0268013 | A1 * | 9/2015 | Heise | F41J 7/04 273/389 |
| 2015/0330748 | A1 * | 11/2015 | Anzalone | F41J 1/10 273/390 |
| 2016/0258720 | A1 | 9/2016 | Côté et al. | |
| 2017/0205207 | A1 | 7/2017 | Anderson | |
| 2017/0219318 | A1 * | 8/2017 | Nicholson | F41J 1/01 |
| 2018/0207502 | A1 | 7/2018 | Remaklus et al. | |

OTHER PUBLICATIONS

International Searching Authority, ISR & Written Opinion, PCT/US2018/015069, dated Apr. 12, 2018, 8 pages.

* cited by examiner

TARGET SYSTEMS AND METHODS FOR PROJECTILES

RELATED APPLICATIONS

This application, U.S. patent application Ser. No. 16/121,406 filed Sep. 4, 2018 claims benefit of U.S. Provisional Application Ser. No. 62/553,131 filed Sep. 1, 2017, U.S. Provisional Application Ser. No. 62/553,211 filed Sep. 1, 2017, and U.S. Provisional Application Ser. No. 62/596,143 filed Dec. 8, 2017, the contents of which are incorporated herein by reference.

TECHNICAL FIELD

The present invention relates to target systems and methods and, in particular, to target systems and pellets towards which projectiles, such as bullets, pellets, BBs, stones, arrows, and knives, are projected.

BACKGROUND

Projectiles are often fired at targets. The present invention is of particular significance when the projectile is a bullet fired from a gun, and that application of the present invention will be described in detail herein. However, the present invention may be used in conjunction with other types of projectiles, and the scope of the present invention should be determined by the claims appended hereto and not the following description of one example type of projectile.

Gun users will fire guns at targets to practice shooting skills. Practice shooting can take place in indoor shooting ranges, restricted outdoor shooting ranges, or in unrestricted outdoor shooting ranges where safe and appropriate. Indoor and restricted outdoor shooting ranges typically have pre-installed target systems and methods. Unrestricted outdoor shooting ranges typically do not have pre-installed target systems and methods, and gun users will install temporary or makeshift targets in unrestricted outdoor shooting ranges. The present invention is of particular significance when used in such unrestricted outdoor shooting ranges.

The need exists for improved temporary target systems and methods for use in outdoor shooting ranges.

SUMMARY

The present invention may be embodied as a target system for projectiles comprising a support system, a primary target, and a secondary target. The support system defines a support portion. The primary target comprises a target portion defining a front side and a rear side, a hanging portion, and a clip arranged on a rear side of the target portion. The clip is adapted to engage the secondary target to secure a secondary target relative to the primary target. The hanging portion is adapted to engage the support portion of the support system to support the primary target at a desired location.

The present invention may also be embodied as a target system for projectiles comprising a support system, a primary target, a secondary target, and a mounting structure. The support system comprises a first support member defining a ground engaging portion and a first connection portion and a second support member defining a second connection portion and a support portion. The primary target comprises a target portion defining a front side and a rear side, a hanging portion, and a clip arranged on a rear side of the target portion. The mounting structure secures the clip to the primary target. The ground engaging portion engages the ground. The first connecting portion engages the second connecting portion such that the support portion is supported relative to the ground. The clip is adapted to engage the secondary target to secure a secondary target relative to the primary target. The hanging portion is adapted to engage the support portion of the support system to support the primary target at a desired location relative to the ground.

The present invention may also be embodied as a method of forming a target for projectiles comprising the following steps. A support portion is supported relative to the ground. A primary target is provided, the primary target comprising a target portion defining a front side and a rear side, a hanging portion, a clip arranged on a rear side of the target portion. A secondary target is provided. The clip is engaged with the secondary target to secure a secondary target relative to the primary target. The hanging portion is engaged with the support portion of the support system to support the primary target at a desired location.

DETAILED DESCRIPTION

Figure 1:
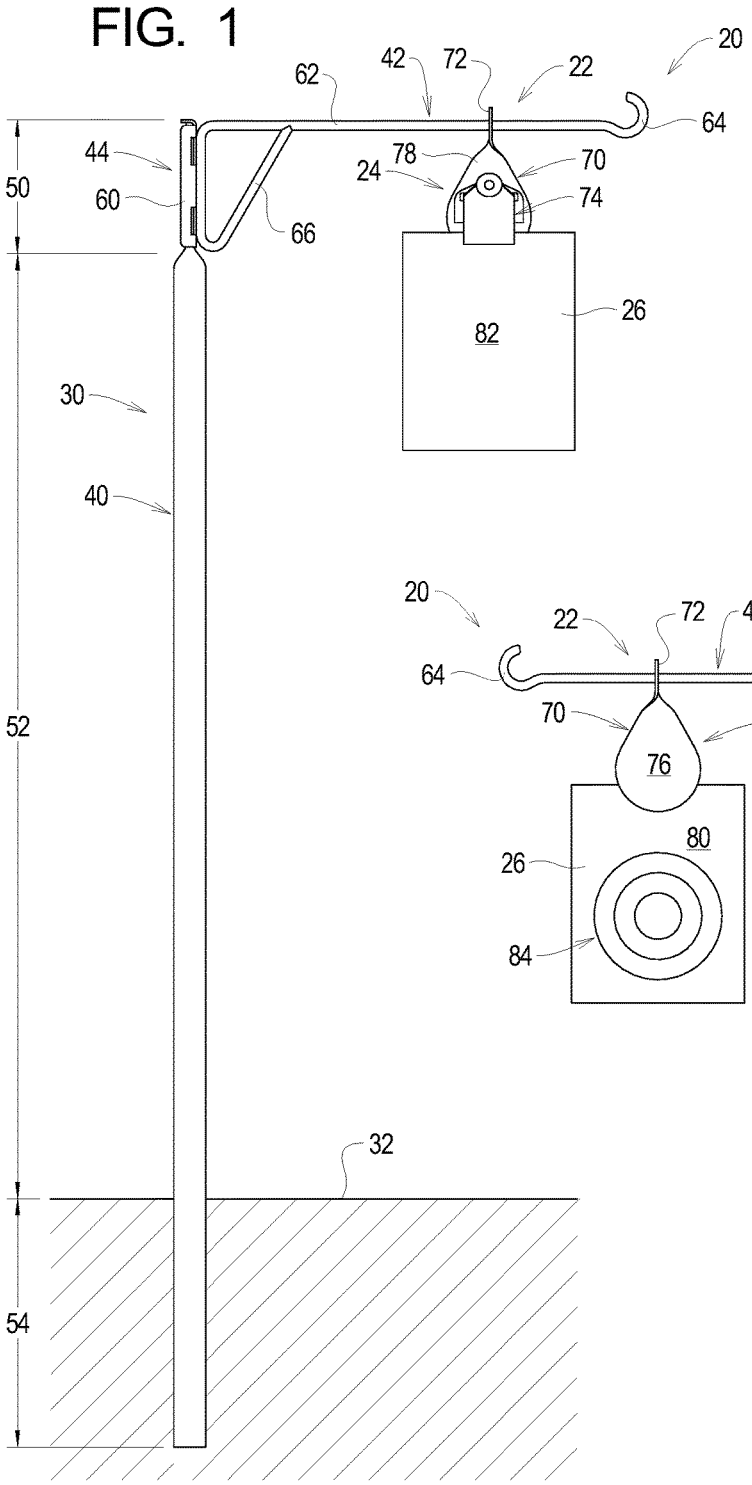
FIG. 1 is a front elevation view of a first example target system of the present invention.

Referring initially to FIGS. 1-8 of the drawing, depicted therein is a first example target system 20 constructed in accordance with, and embodying, the principles of the present invention. The first example target system 20 comprises a support system 22 and a first example primary target 24. As illustrated in FIGS. 1, 2, 5, and 7, the first example primary target 24 is supporting a secondary target 26.

In use, the support system 22 supports the first example primary target 24 at a first desired location, and the first example primary target 24 in turn supports the secondary target 26 at a second desired location immediately below the first desired location. The first example target system 20 may be used as a temporary target in an improvised outdoor shooting range.

The example support system 22 comprises a main support assembly 30 that engages the ground 32. The example support system 22 further comprises a first support member 40, a second support member 42, and a connection system 44. The example first support member 40 comprises a first connection portion 50, a spacing portion 52, and a ground engaging portion 54. The example second support member 42 comprises a second connection portion 60, a support portion 62, an end portion 64, and a brace portion 66. The ground engaging portion 54 of the first support member 40 engages the ground 32, and the spacing portion 52 spaces the first connecting portion 50 above the ground 32. The first connection portion 50 engages the second connection portion 60 to form the connection system 44 such that the support portion 62 of the second example support member 42 extends from a desired location and at a desired orientation relative to the ground 32.

Alternative support systems may be used instead of the example support system 22. For example, instead of engaging the ground 32, the first support member 40 may be supported from a structure such as a fence or tree. As another example, the first connection portion 50 may be formed on a bracket adapted to be connected to a structure such as a fence or tree. As another example, the first support system 22 may be supported directly on another structure such as a fence or tree.

Further, the first example primary target 24 may be used without a prefabricated support structure such as the example support structure 22. For example, the first example primary target 24 may be directly connected to an existing structure such as the limb of tree or bush.

The first example primary target 24 is made of metal or other rigid material and comprises a target portion 70, a hanging portion 72, and a clip 74. The target portion 70 defines a target surface 76 and a rear surface 78. The hanging portion 72 is configured to engage the support portion 62 of the example support system 22 as depicted in FIG. 1. The example hanging portion 72 is formed by a hole formed in the primary target 24, but the hanging portion 72 may be formed by a hook, chain, closed loop, or the like capable of supporting the target 24 from the support portion 62 of the support system 22.

Alternatively, the hanging portion 72 may be configured to engage an existing structure such as a fence or tree. The target portion 70 may form a target for the user. Alternatively, as shown in FIGS. 1, 2, 5, and 7, the clip 74 may be used to secure the secondary target 26 to the primary target 24 so that the secondary target 26 forms the target for the user.

The example secondary target 26 is a sheet of thin material such as paper, cloth, or the like defining a front side 80 and a rear side 82. Indicia 84 in the form of a circular target symbol is printed or otherwise visible on the front side 80 of the example secondary target 26. The user will typically aim at the indicia 84 or some portion thereof when the secondary target 26 forms the target for the user. Alternatively, the secondary target 26 may be an object, such as a can, capable of forming a suitable aiming point for the user.

The example first connecting portion 50 and second connecting portion 60 engage each other to allow the first support member 40 to be detachably attached to the second support member 42. FIGS. 3-6 illustrate that the example first connecting portion 50 may take the form of a blade 90 formed on the end of the first support member 40 distal from the ground engaging portion 54. The blade 90 may be formed by securing (e.g., welding, gluing, or the like) an appropriate structure to the spacing portion 52 or by stamping or otherwise deforming an end of a pipe forming the spacing portion 52. The example second connecting portion 60 takes the form of a channel 92 defined by first and second side walls 94 and 96 and an end wall 98. The blade 90 and channel 92 and are sized and dimensioned such that the channel 92 receives the blade 90 to form a friction fit that secures the first support member 40 and second support member 42 together but which allows the first and second support members 40 and 42 to be detachably attached by use of manual force and/or a tool.

Figure 2:
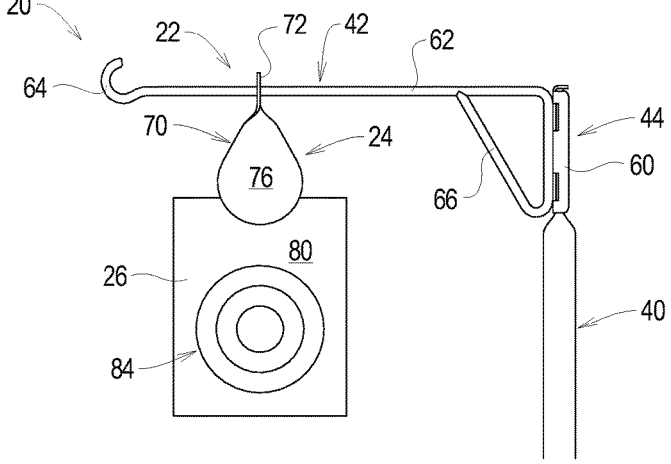
FIG. 2 is a rear elevation view of the first example target system.
Figure 3:
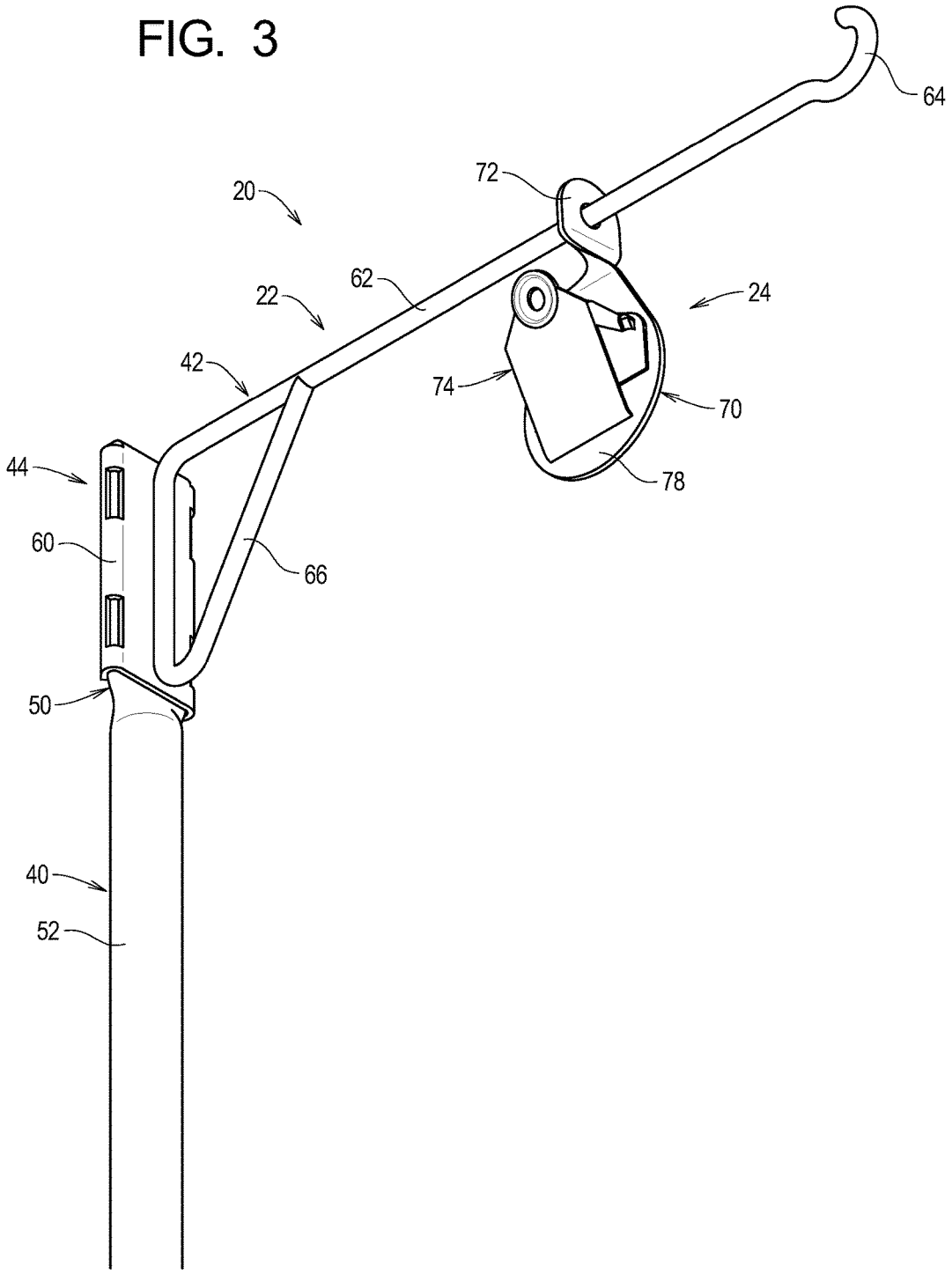
FIG. 3 is a rear perspective view of the second example target system illustrating a support system in an assembled configuration.
Figure 4:
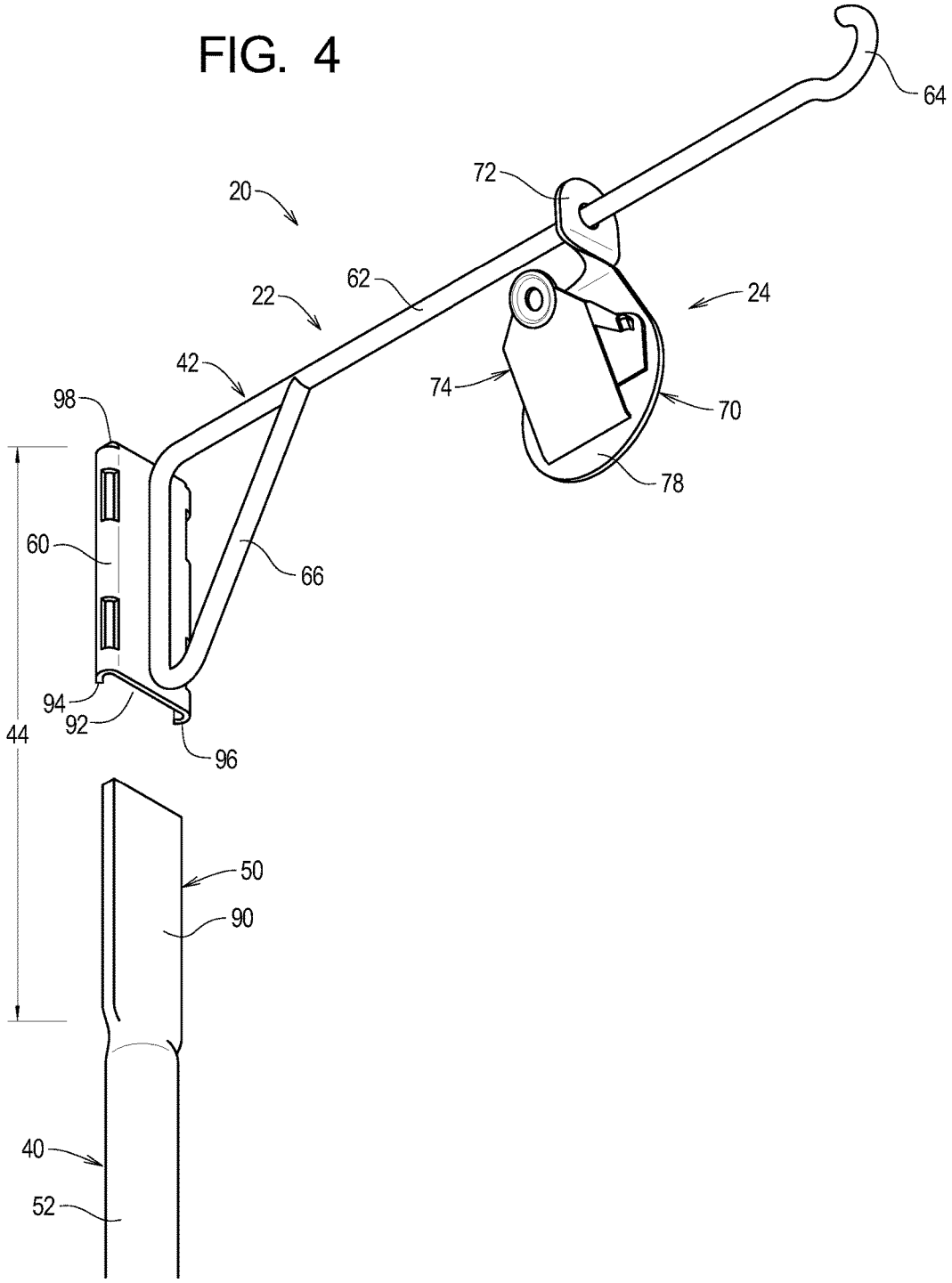
FIG. 4 is a rear perspective view of the first example target system illustrating a support system in a disassembled configuration.
Figures 5, 6:
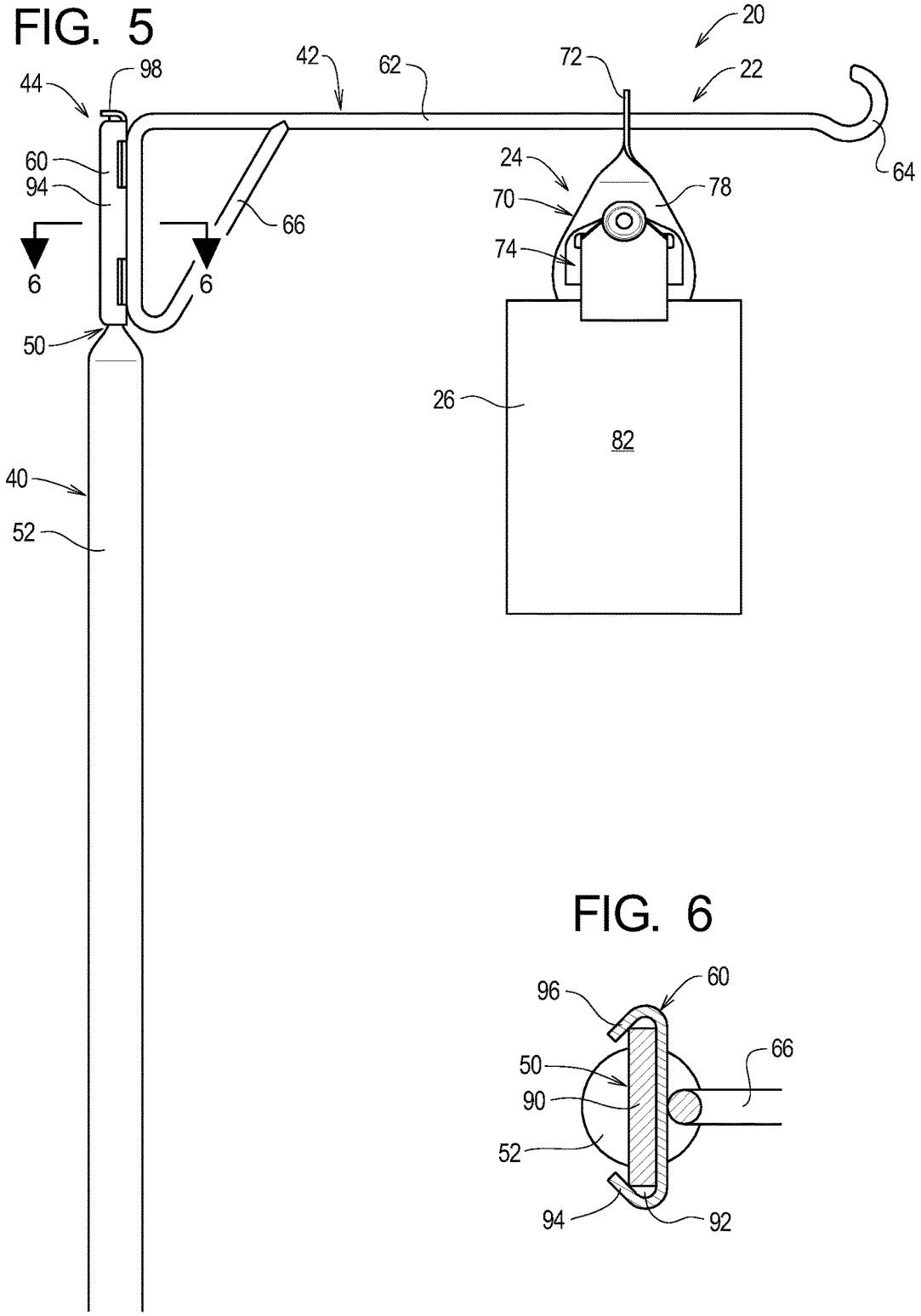
FIG. 5 is a rear elevation view of a portion of the first example target system of the present invention.
FIG. 6 is a section view taken along lines 6-6 in FIG. 5.
Figures 7, 8:
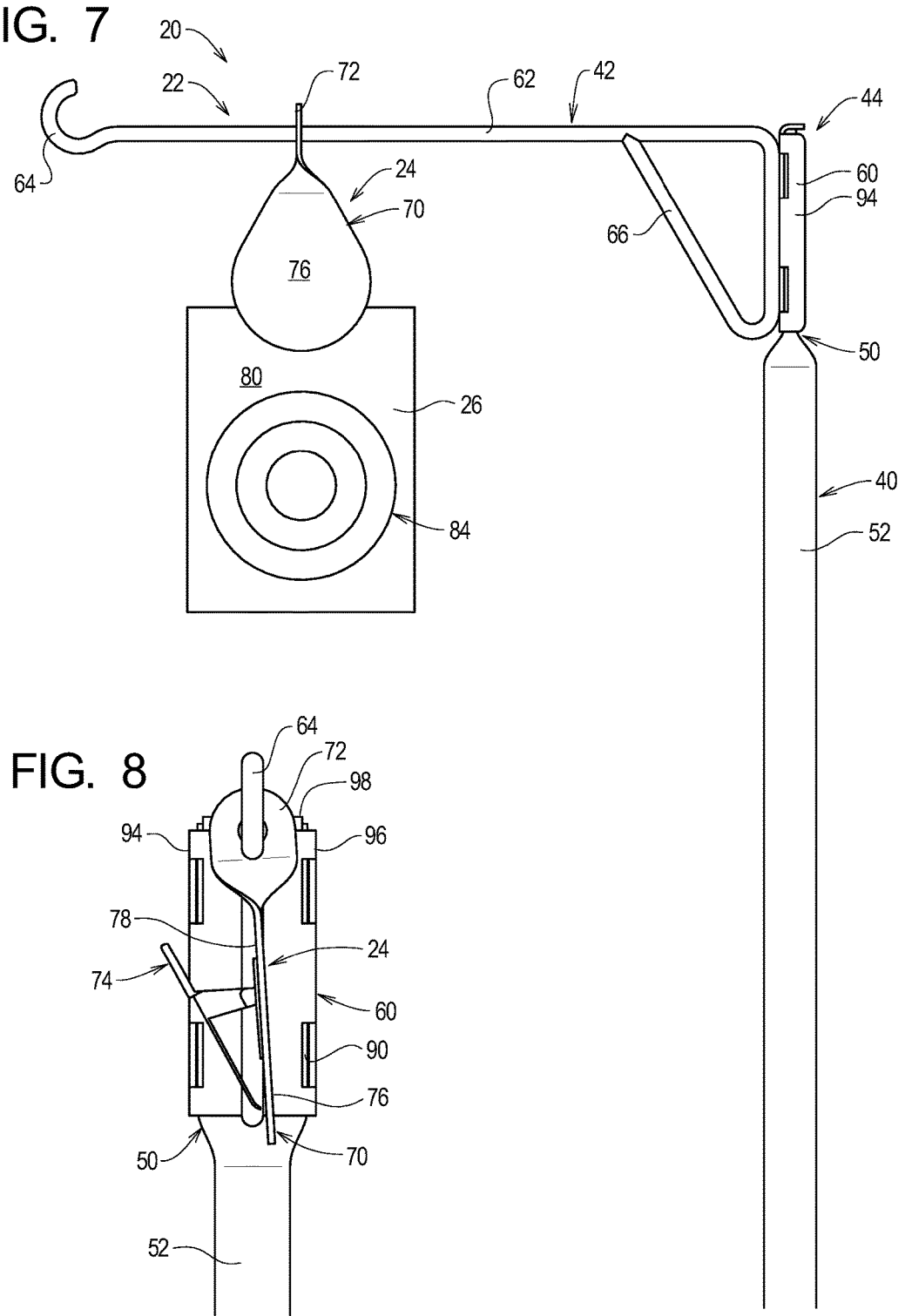
FIG. 7 is a front elevation view of a portion of the first example target system of the present invention.
FIG. 8 is a side elevation view of a portion of the first example target system of the present invention.

As shown in FIGS. 1, 2, 7, and 8, spacing portion 52 of the first support member 40 is typically vertical during normal use and the second support member 42 extends at a right angle from the first support member 40 such that the support portion 62 is substantially horizontal during normal use. The hanging portion 72 of the first example primary target 24 engages support portion 62 of the second support member 42 such that the target portion 70 of the first example primary target 24 is arranged below the support portion 62 of the second support member 42. Further, when clip 74 attaches the secondary target 26 to the target portion 70, the secondary target 26 hangs below at least a portion of the first example primary target 24. Accordingly, when viewed as shown in FIGS. 2 and 7, the user thus has the option of targeting one or both of the target portion 70 of the first example primary target 24 and the indicia 84 on the secondary target 26.

Figure 9:
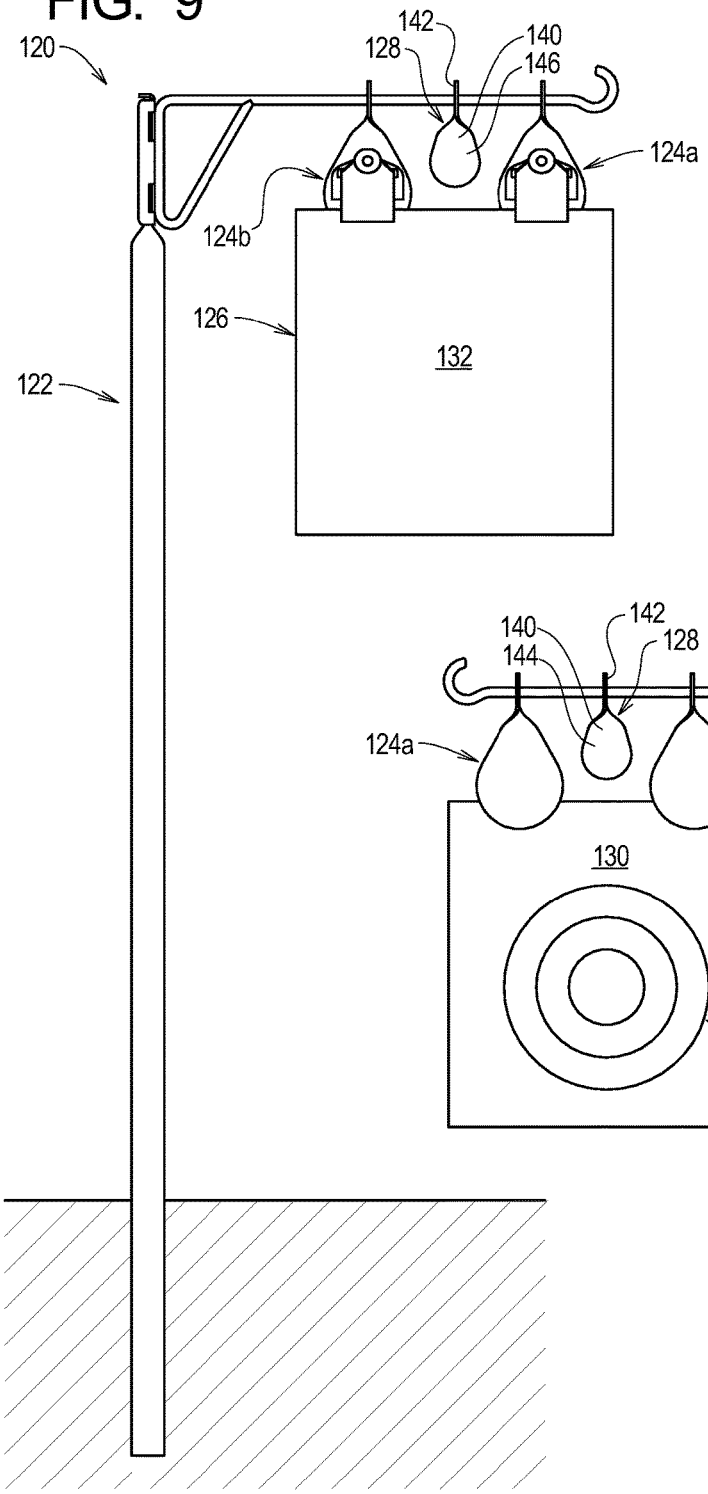
FIG. 9 is a front elevation view of a second example target system of the present invention.
Figure 10:
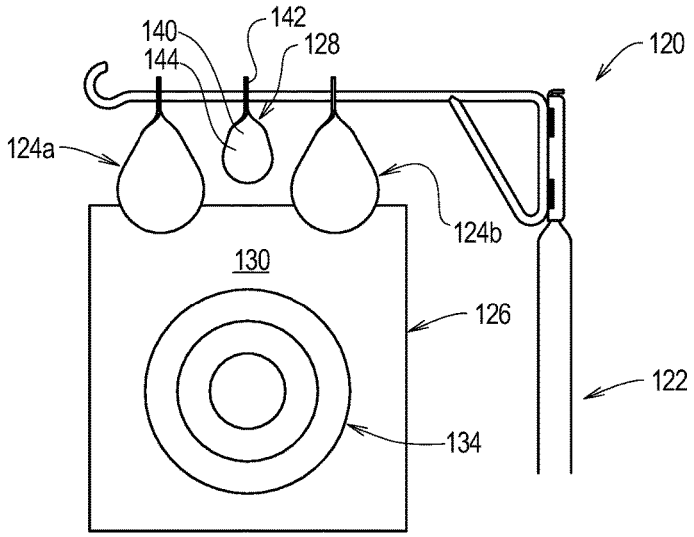
FIG. 10 is a rear elevation view of the second example target system of the present invention.

Turning now to FIGS. 9 and 10 of the drawing, depicted therein is a second example target system 120 constructed in accordance with, and embodying, the principles of the present invention. The second example target system 120 comprises a support system 122, a plurality of primary targets **124*a* and 124*b*, a secondary target 126, and an ancillary target 128**.

The example support system 122 is or may be the same as the example support system 22 described above or may be omitted as also described above. The primary targets **124*a* and 124*b* are or may be the same as the first example primary target 24 described above. The example secondary target 126 defines a front side 130 and a rear side 132 and indicia 134 are formed on the front side 130. The example secondary target 126 is larger than the example secondary target 26 described above but otherwise is or may be the same as the example second target 26. Alternatively, the secondary target 126** may be an object, such as a can, capable of forming a suitable aiming point for the user.

Because the example secondary target 126 is relatively large, the clips of two of the primary targets **124*a* and 124*b* are used to secure the secondary target 126 in a desired location relative to the example support system 122**.

The example ancillary target 128 defines an ancillary target portion 140 and an ancillary hanging portion 142. The ancillary target portion 140 defines an ancillary target surface 144 and an ancillary rear surface 146. Aside from not having a clip and being smaller, the example ancillary target 128 is the same as the first example primary target 24 described above.

When viewed as shown in FIG. 10, the user has the option of targeting any one, two, or all of the target portion of the either of the example primary targets 124*a* and 124*b*, the indicia 134 on the secondary target 126, and the target surface 144 on the target portion 140 of the ancillary target 128.

Figure 11:
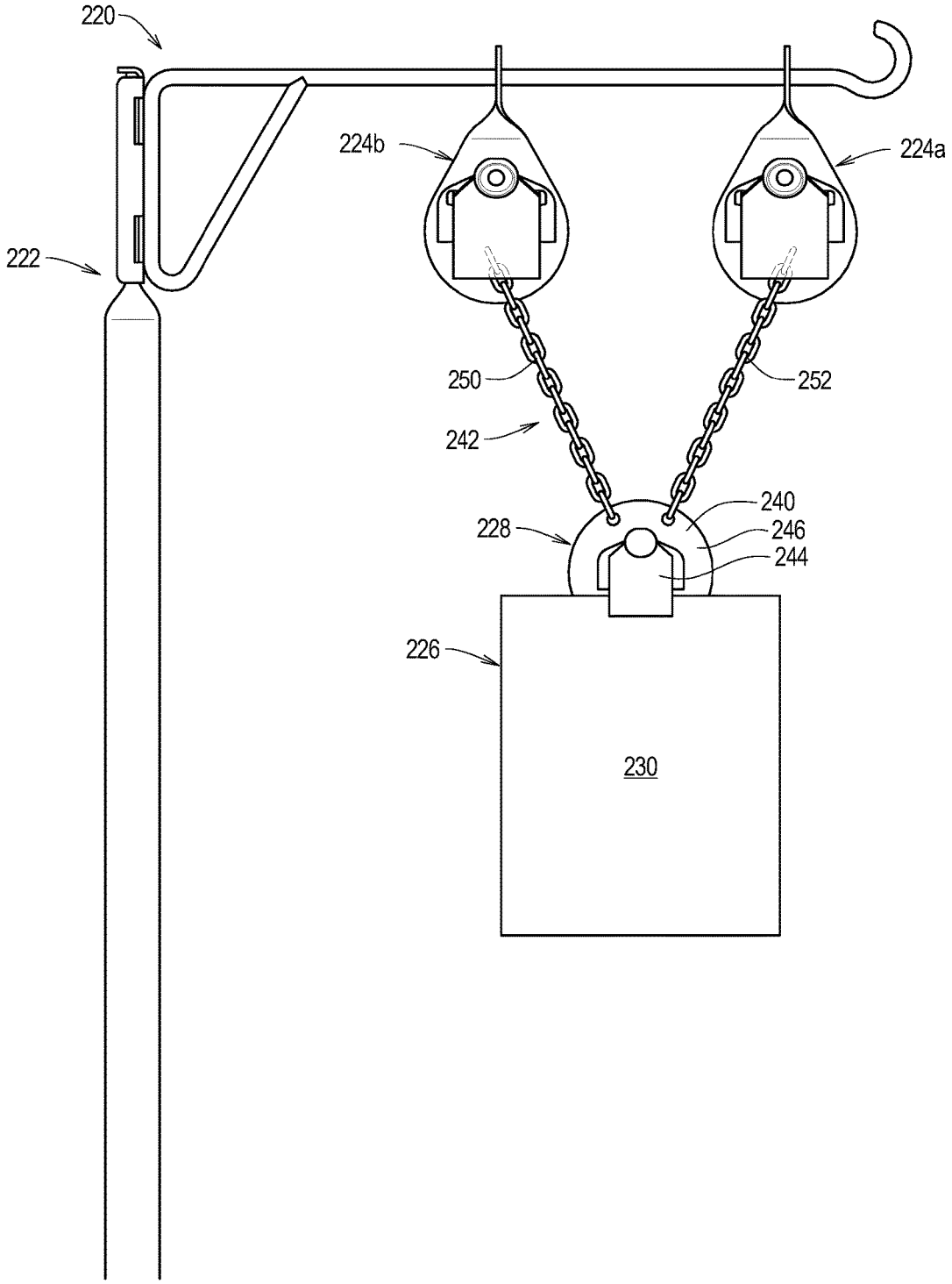
FIG. 11 is a rear elevation view of a portion of a third example target system of the present invention.

Turning now to FIG. 11, depicted therein is a third example target system 220 constructed in accordance with, and embodying, the principles of the present invention. The second example target system 120 comprises a support system 222, a plurality of primary targets 224*a* and 224*b*, a secondary target 226, and an ancillary target 228.

The example support system 222 is or may be the same as the example support system 22 described above or may be omitted as also described above. The primary targets 224*a* and 224*b* are or may be the same as the first example primary target 24 described above. The example secondary target 226 defines a front side (not visible in FIG. 11) and a rear side 230; indicia (not visible) are typically formed on the front side. The example secondary target 226 is or may be the same as the example second target 26 described above. Alternatively, the secondary target 226 may be an object, such as a can, capable of forming a suitable aiming point for the user.

The example ancillary target 228 defines an ancillary target plate 240, an ancillary hanging portion 242, and an ancillary clip 244. The ancillary target plate 240 defines an ancillary target surface (not visible in FIG. 11) and an ancillary rear surface 246. The example ancillary hanging portion 242 comprises a first elongate 250 and a second elongate member 252. The elongate members 250 and 252 extend from the ancillary target plate 240 to the clips of the first and second primary targets 224*a* and 224*b*. The elongate members 250 and 252 thus allow the ancillary target 228 to support the secondary target 226 below the first and second primary targets 224*a* and 224*b*.

When viewed as shown in FIG. 11, the user has the option of targeting any one, two, or all of the target portion of the either of the example primary targets 224*a* and 224*b*, the secondary target 226, and the ancillary target 228.

Figure 12:
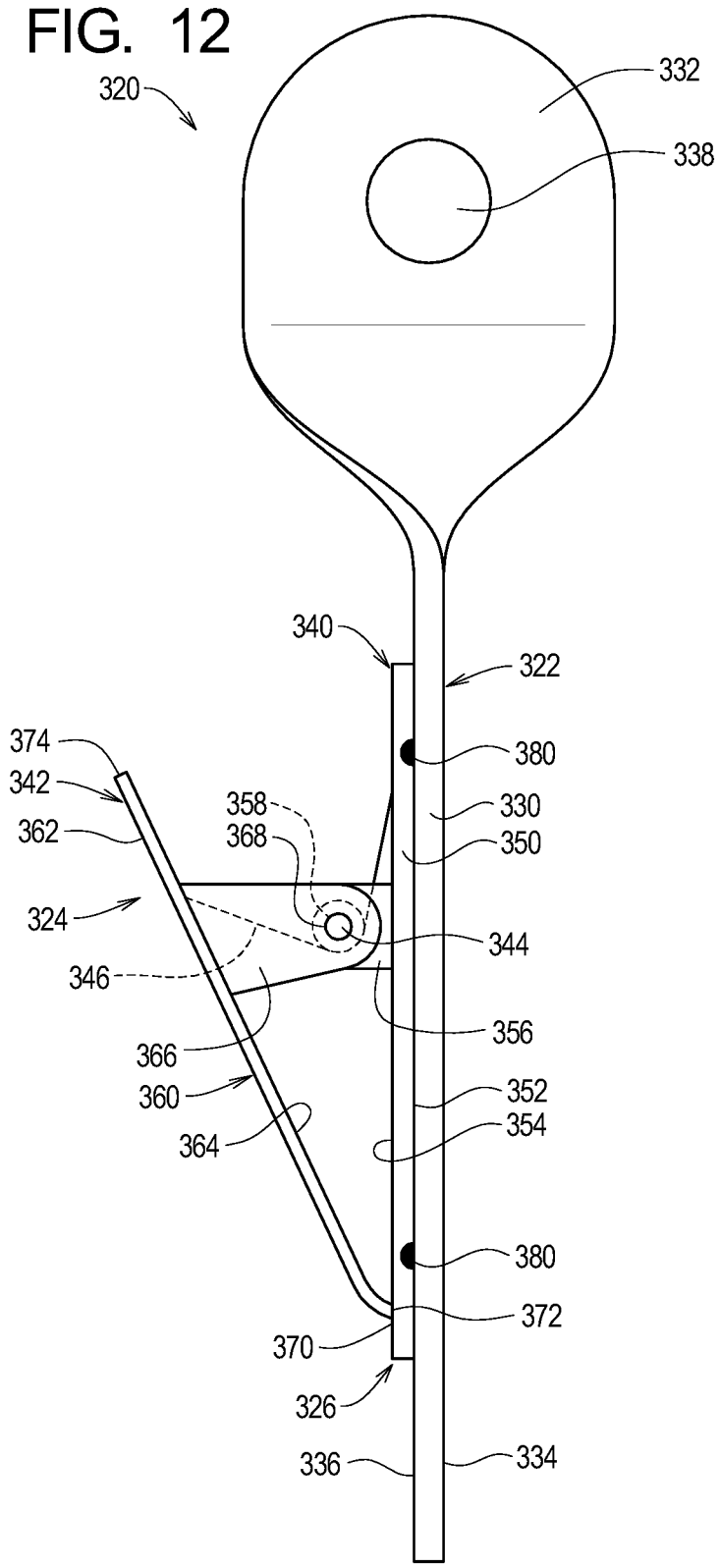
FIG. 12 is a side elevation view of a second example ancillary target plate system of the present invention.

Turning now to FIG. 12, depicted therein is a second example primary target 320 that may be used as any one or more of the primary targets 24, 124*a* and/or 124*b*, 224*a* and/or 224*b* of the example target systems 20, 120, and 220 described above.

The second example primary target 320 comprises a plate member 322, a clip assembly 324, and a first example mounting structure 326. The example plate member 322 defines a target portion 330 and a connecting portion 332. The example plate member 322 is formed from a flat sheet of rigid material such as metal or plastic that has been deformed by stamping, hot working, or the like such that a target plane defined by the target portion 330 is at substantially a right angle to a connecting plane defined by the connecting portion 332. The target portion defines a target surface 334 and a rear surface 336. A connecting opening 338 is formed in the connecting portion 332.

The example clip assembly 324 comprise a first clip structure 340, a second clip structure 342, a clip pin 344, and a clip biasing member 346. The first clip structure 340 defines a first clip plate 350 defining a clip mounting surface 352 and a first pivot surface 354. One or more first pivot flange(s) 356 extend from the clip pivot surface 354. A first pivot opening 358 is formed in each first pivot flanges 356. The second clip structure 342 defines a second clip plate 360 defining an outer surface 362 and a second pivot surface 364. One or more second pivot flange(s) 366 extend from the second pivot surface 364. A second pivot opening 368 is formed in each second pivot flange 366. The clip pin 344 extends through the aligned first and second pivot openings 358 and 368 such that the first and second clip structures 340 and 342 pivot relative to each other about a pivot axis defined by the clip pin 344 between a closed configuration as shown in FIG. 12 and an open configuration (not shown).

In the closed configuration, a first engaging portion 370 of the first clip plate 350 is in contact with a second engaging portion 372 on the second clip plate 360. The clip biasing member 346 is arranged to bias the first and second clip structures 340 and 342 into the closed configuration. The example clip biasing member 346 may take the form of a torsion spring. A lever portion 374 is formed on an opposite end of the second pivot plate 360 to facilitate displacement of the second clip plate 360 relative to the first clip plate 350 to place the first and second clip structures into the open configuration against the force of the clip biasing member 346.

A secondary target such as the secondary targets 26, 126, or 226 or the second ancillary target 228 described above may be secured to the plate member 322 by the example clip assembly 324 in the closed position. A secondary target such as the secondary targets 26, 126, or 226 or the second ancillary target 228 described above may be removed from the second example primary target 320 with the example clip assembly 324 in the open position.

The first example mounting system 326 is formed by one or more mounting locations 380 that physically join the first clip plate 350 to the plate member 322. The mounting locations 380 may be formed by welds, rivets, bolt assemblies, or the like. The mounting locations 380 are formed in a number and at locations sufficient to connect the clip assembly 324 relative to the plate member 322 such that movement between the clip assembly 324 and plate member 322 is inhibited during normal use of the second example primary target 320.

Figure 13:
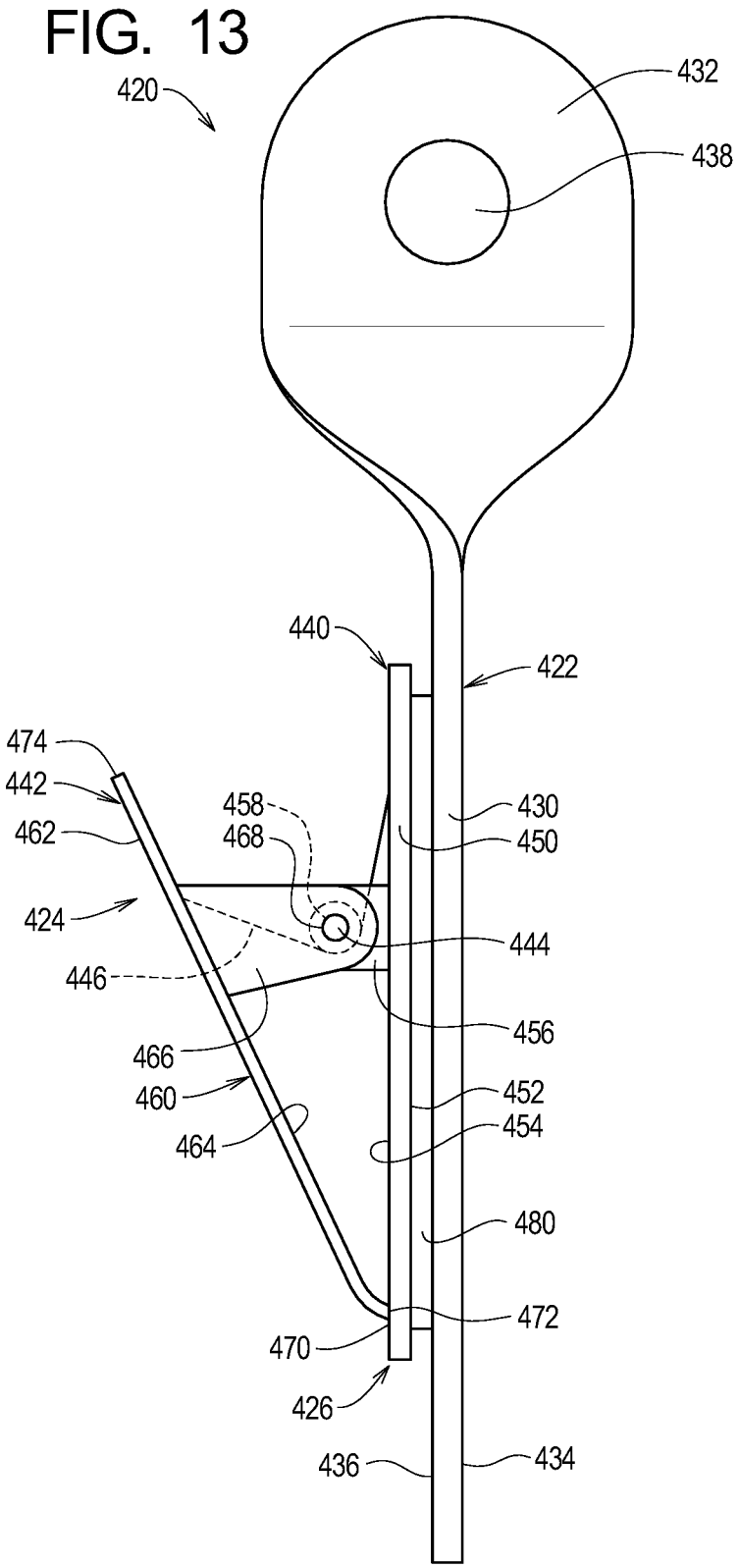
FIG. 13 is a side elevation view of a third example ancillary target plate system of the present invention.

FIG. 13 depicts a third example primary target 420 that may be used as any one or more of the primary targets 24, 124*a* and/or 124*b*, 224*a* and/or 224*b* of the example target systems 20, 120, and 220 described above.

The third example primary target 420 comprises a plate member 422, a clip assembly 424, and a second example mounting structure 426. The example plate member 422 defines a target portion 430 and a connecting portion 432. The example plate member 422 is formed from a flat sheet of rigid material such as metal or plastic that has been deformed by stamping, hot working, or the like such that a target plane defined by the target portion 430 is at substantially a right angle to a connecting plane defined by the connecting portion 432. The target portion defines a target surface 434 and a rear surface 436. A connecting opening 438 is formed in the connecting portion 432.

The example clip assembly 424 comprise a first clip structure 440, a second clip structure 442, a clip pin 444, and a clip biasing member 446. The first clip structure 440 defines a first clip plate 450 defining a clip mounting surface 452 and a first pivot surface 454. One or more first pivot flange(s) 456 extend from the clip pivot surface 454. A first pivot opening 458 is formed in each first pivot flanges 456. The second clip structure 442 defines a second clip plate 460 defining an outer surface 462 and a second pivot surface 454. One or more second pivot flange(s) 466 extend from the second pivot surface 464. A second pivot opening 468 is formed in each second pivot flange 466. The clip pin 444 extends through the aligned first and second pivot openings 458 and 468 such that the first and second clip structures 440 and 442 pivot relative to each other about a pivot axis defined by the clip pin 444 between a closed configuration as shown in FIG. 13 and an open configuration (not shown).

In the closed configuration, a first engaging portion 470 of the first clip plate 450 is in contact with a second engaging portion 472 on the second clip plate 460. The clip biasing member 446 is arranged to bias the first and second clip structures 440 and 442 into the closed configuration. The example clip biasing member 446 may take the form of a torsion spring. A lever portion 474 is formed on an opposite end of the second pivot plate 460 to facilitate displacement of the second clip plate 460 relative to the first clip plate 450 to place the first and second clip structures into the open configuration against the force of the clip biasing member 446.

A secondary target such as the secondary targets 26, 126, or 226 or the second ancillary target 228 described above may be secured to the plate member 422 by the example clip assembly 424 in the closed position. A secondary target such as the secondary targets 26, 126, or 226 or the second ancillary target 228 described above may be removed from the third example primary target 420 with the example clip assembly 424 in the open position.

The second example mounting system 426 comprise an adhesive layer 480 that physically joins the first clip plate 450 to the plate member 422. The adhesive layer 480 may be formed by glue, double stick pressure sensitive adhesive tape, or the like. The adhesive layer 480 is formed in a size and at one or more locations sufficient to connect the clip assembly 424 relative to the plate member 422 such that movement between the clip assembly 424 and plate member 422 is inhibited during normal use of the third example primary target 420.

Figure 14:
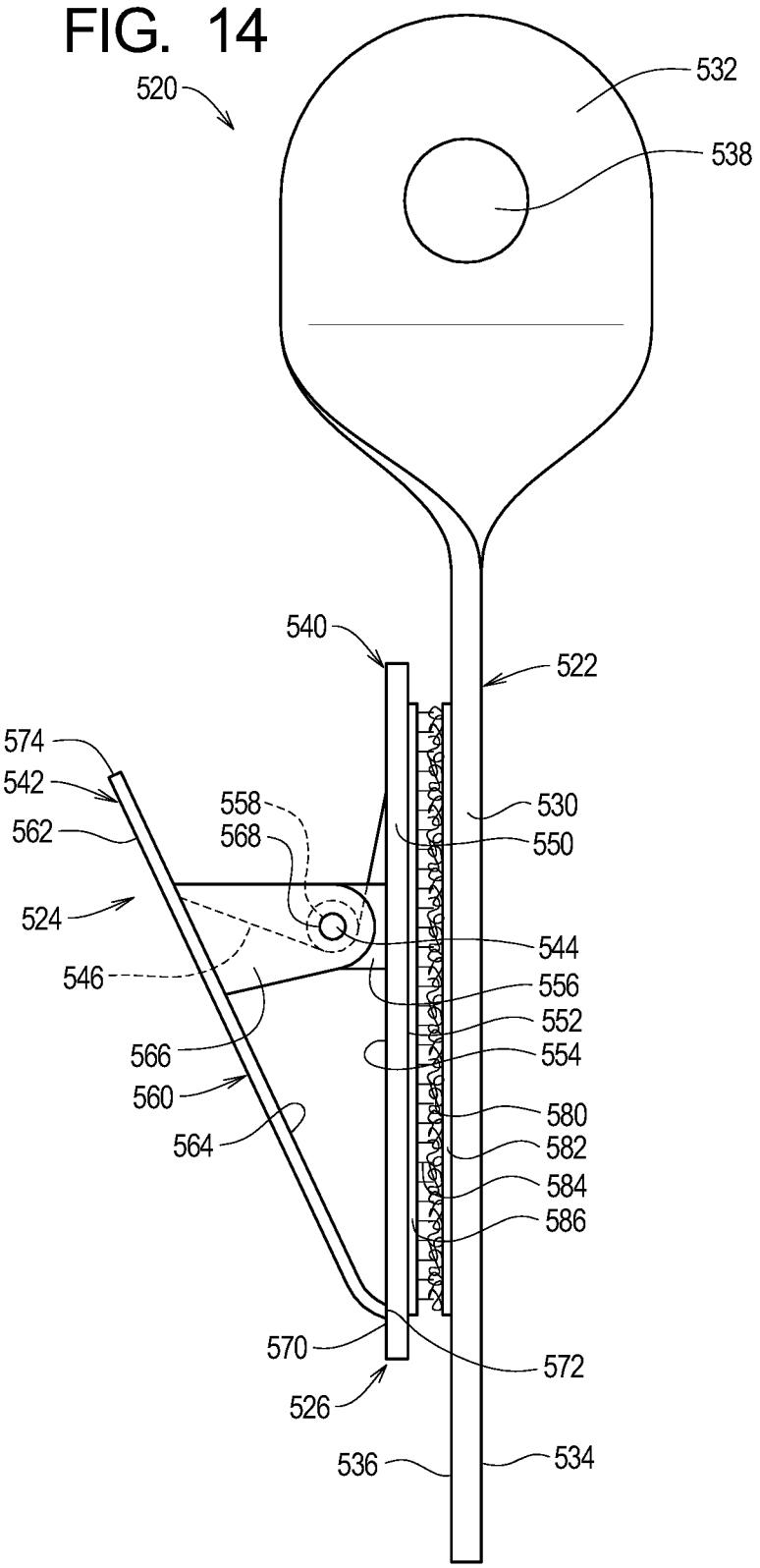
FIG. 14 is a side elevation view of a fourth example ancillary target plate system of the present invention.

FIG. 14 depicts a fourth example primary target 520 that may be used as any one or more of the primary targets 24, 124*a* and/or 124*b*, 224*a* and/or 224*b* of the example target systems 20, 120, and 220 described above.

The fourth example primary target 520 comprises a plate member 522, a clip assembly 524, and a first example mounting structure 526. The example plate member 522 defines a target portion 530 and a connecting portion 532. The example plate member 522 is formed from a flat sheet of rigid material such as metal or plastic that has been deformed by stamping, hot working, or the like such that a target plane defined by the target portion 530 is at substantially a right angle to a connecting plane defined by the connecting portion 532. The target portion defines a target surface 534 and a rear surface 536. A connecting opening 538 is formed in the connecting portion 532.

The example clip assembly 524 comprise a first clip structure 540, a second clip structure 542, a clip pin 544, and a clip biasing member 546. The first clip structure 540 defines a first clip plate 550 defining a clip mounting surface 552 and a first pivot surface 554. One or more first pivot flange(s) 556 extend from the clip pivot surface 554. A first pivot opening 558 is formed in each first pivot flanges 556. The second clip structure 542 defines a second clip plate 560 defining an outer surface 562 and a second pivot surface 554. One or more second pivot flange(s) 566 extend from the second pivot surface 564. A second pivot opening 568 is formed in each second pivot flange 566. The clip pin 544 extends through the aligned first and second pivot openings 558 and 568 such that the first and second clip structures 540 and 542 pivot relative to each other about a pivot axis defined by the clip pin 544 between a closed configuration as shown in FIG. 14 and an open configuration (not shown).

In the closed configuration, a first engaging portion 570 of the first clip plate 550 is in contact with a second engaging portion 572 on the second clip plate 560. The clip biasing member 546 is arranged to bias the first and second clip structures 540 and 542 into the closed configuration. The example clip biasing member 546 may take the form of a torsion spring. A lever portion 574 is formed on an opposite end of the second pivot plate 560 to facilitate displacement of the second clip plate 560 relative to the first clip plate 550 to place the first and second clip structures into the open configuration against the force of the clip biasing member 546.

A secondary target such as the secondary targets 26, 126, or 226 or the second ancillary target 228 described above may be secured to the plate member 522 by the example clip assembly 524 in the closed position. A secondary target such as the secondary targets 26, 126, or 226 or the second ancillary target 228 described above may be removed from the fourth example primary target 520 with the example clip assembly 524 in the open position.

The third example mounting system 526 comprise a first mounting sheet 580, a first adhesive layer 582, a second mounting sheet 584, and a second adhesive layer 586. The first adhesive layer 582 that physically joins the first mounting sheet 580 to the plate member 522. The second adhesive layer 586 physically joins second mounting sheet to the first clip plate 550. The mounting sheets 580 and 584 are formed, for example, by hook and loop fastener system that uses physical interaction of hooks and loops to join the first and second mounting sheets 580 and 584 together. The adhesive layers 582 and 586 may be formed by glue, double stick pressure sensitive adhesive tape, or the like. The adhesive layers 582 and 586 are formed in a size and at one or more locations sufficient to securely hold the first and second mounting sheets 580 and 584 together such that the clip assembly 524 is sufficiently fixed relative to the plate member 522 such that movement between the clip assembly 524 and plate member 522 is inhibited during normal use of the fourth example primary target 520.

Figure 15:
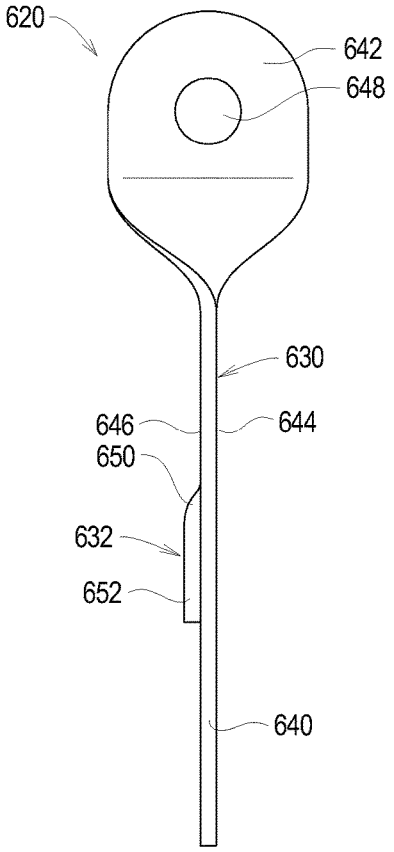
FIG. 15 is a side elevation view of a fifth example ancillary target plate system of the present invention.
Figure 16:
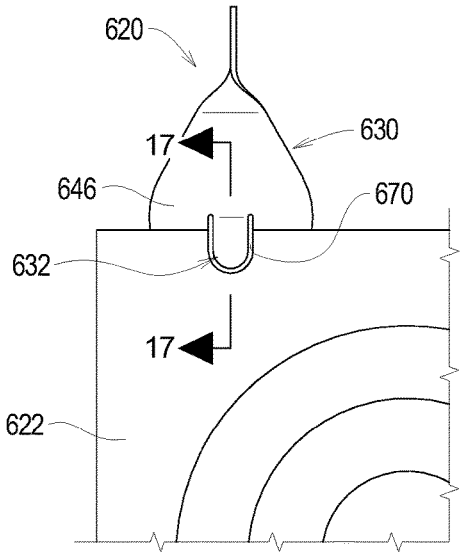
FIG. 16 is a front elevation view of the fifth example ancillary target plate system.
Figure 17:
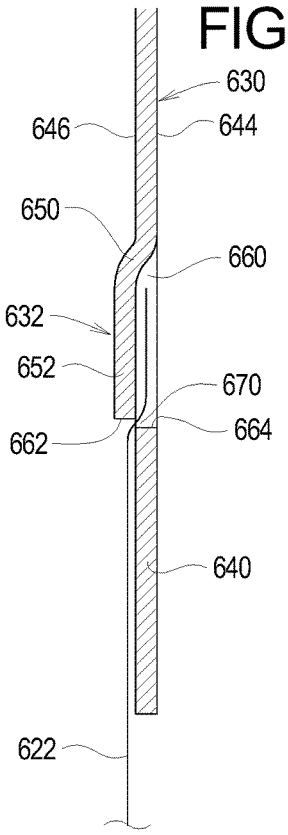
FIG. 17 is a side elevation view of the fifth example ancillary target plate system taken along lines 17-17 in FIG. 16.

FIGS. 15-17 depict a fifth example primary target 620 for supporting a sheet member 622 to be used a secondary target. The example primary target 620 comprises a plate member 630 and a clip portion 632.

The example plate member 630 comprises a target portion 640 and a connecting portion 642. The example plate member 630 is formed from a flat sheet of rigid material such as metal or plastic that has been deformed by stamping, hot working, or the like such that a target plane defined by the target portion 640 is at substantially a right angle to a connecting plane defined by the connecting portion 642. The target portion defines a target surface 644 and a rear surface 646. A connecting opening 648 is formed in the connecting portion 642.

The example clip portion 632 comprises a neck portion 650 and an offset portion 652. The example clip portion 632 is formed by forming a U-shaped slot 660 in the target portion 640 of the plate member 630 and deforming the plate member 630 within the slot 660 such that the neck portion 650 extends at an angle rearwardly from the target portion 640 and the offset portion 652 is offset relative to, and substantially parallel to, the target plane defined by the target portion. A clip edge 662 is formed by the clip portion 632 on one side of the slot 660, and a plate edge 664 is formed on the plate member 630 on the other side of the slot 660. A gap 670 is formed between the clip edge 662 and the plate edge 664.

As perhaps best shown in FIG. 17, the sheet member 622 may be forced through the gap 670 such that a portion of the sheet member 622 is between the clip portion 632 and the rear surface 646 of the target portion 640. The friction between the sheet member 622 and the clip portion 632 on one side and the rear surface 646 of the target portion 640 on the other side will detachably attach the sheet member 622 to the plate 630.

A secondary target such as the secondary targets 26, 126, or 226 or the second ancillary target 228 described above may be secured to the plate member 422 by the inserting a portion of the secondary target through the gap 670 such that a clamping force and/or friction secure the ancillary target to the plate 630. A secondary target such as the secondary targets 26, 126, or 226 or the second ancillary target 228 described above may be removed from the fourth example primary target 420 by deliberate application of manual force on the ancillary target away from the plate 630.

What is claimed is:

1. A target system for projectiles comprising:
a support system defining a support portion;
a primary target comprising
a target portion defining a front side and a rear side,
a hanging portion,
a clip arranged on a rear side of the target portion; and
a secondary target; and
a mounting structure for securing the clip to the primary target, where the mounting structure comprises a first mounting sheet secured to the clip and a second mounting sheet secured to the rear surface of the target portion of the primary target; wherein
the first mounting sheet is detachably attachable to the second mounting sheet to detachably attach the clip to the primary target;
the clip is adapted to engage the secondary target to secure a secondary target relative to the primary target; and
the hanging portion is adapted to engage the support portion of the support system to support the primary target at a desired location.

2. A target system as recited in claim 1, in which the mounting structure comprises first and second adhesive layers, where:
the first adhesive layer secures the first mounting sheet to the clip; and
the second adhesive layer secures the second mounting sheet to the rear surface of the target portion of the primary target.

3. A target system as recited in claim 1, in which the clip comprises:
a first clip structure;
a second clip structure;
a clip pin; and
a clip biasing member; wherein
the clip pin rotatably supports the first and second clip structures such that the first and second clip structures rotate between closed and open positions relative to each other; and
the clip biasing member biases the first and second clip structures into the closed position.

4. A target system as recited in claim 1, further comprising an ancillary target supported by the support portion of the support system.

5. A target system as recited in claim 1, comprising a plurality of the primary targets, wherein the secondary target is supported by the clips of the plurality of primary targets.

6. A target system as recited in claim 1, further comprising:
a plurality of primary targets; and
an ancillary target supported by the clips of the plurality of primary targets.

7. A target system as recited in claim 1, in which the support system comprises:
a first support member defining a ground engaging portion and a first connecting portion; and
a second support member defining the support portion and a second connecting portion; wherein
the ground engaging portion engages the ground to support the first support member; and
the first connecting portion engages the second connecting portion to support the second support member at a desired location relative to the ground.

8. A target system for projectiles comprising:
a support system defining a support portion;
a primary target comprising
a target portion defining a front side and a rear side,
a hanging portion,
a clip arranged on a rear side of the target portion, where the clip comprises
a first clip structure;
a second clip structure;
a clip pin; and
a clip biasing member; and
a secondary target; wherein
the clip is adapted to engage the secondary target to secure a secondary target relative to the primary target;
the hanging portion is adapted to engage the support portion of the support system to support the primary target at a desired location;
the clip pin rotatably supports the first and second clip structures such that the first and second clip structures rotate between closed and open positions relative to each other; and
the clip biasing member biases the first and second clip structures into the closed position.

9. A target system as recited in claim 8, further comprising an ancillary target supported by the support portion of the support system.

10. A target system as recited in claim 8, comprising a plurality of the primary targets, wherein the secondary target is supported by the clips of the plurality of primary targets.

11. A target system as recited in claim 8, further comprising:
a plurality of primary targets; and
an ancillary target supported by the clips of the plurality of primary targets.

12. A target system for projectiles comprising:
a support system defining a support portion;
a primary target comprising
a target portion defining a front side and a rear side,
a hanging portion,
a clip arranged on a rear side of the target portion, where the clip portion is defined by a U-shaped slot formed in the target portion of the primary target, where the U-shaped slot is sized and dimensioned to receive at least a portion of the secondary target; and
a secondary target; wherein
the clip is adapted to engage the secondary target to secure a secondary target relative to the primary target; and the hanging portion is adapted to engage the support portion of the support system to support the primary target at a desired location.

13. A target system as recited in claim 12, in which the clip portion comprises:

a neck portion that extends rearwardly from the target portion; and an offset portion that is offset relative to a target plane defined by the target portion.

14. A target system as recited in claim 12, further comprising an ancillary target supported by the support portion of the support system.

15. A target system as recited in claim 12, comprising a plurality of the primary targets, wherein the secondary target is supported by the clips of the plurality of primary targets.

16. A target system as recited in claim 12, further comprising:

a plurality of primary targets; and an ancillary target supported by the clips of the plurality of primary targets.

* * * * *